United States Patent [19]

Edwards

[11] Patent Number: 4,609,071

[45] Date of Patent: Sep. 2, 1986

[54] COLLAPSIBLE SCAFFOLD

[75] Inventor: Paul M. Edwards, Indianapolis, Ind.

[73] Assignee: Perry Manufacturing Incorporated, Indianapolis, Ind.

[21] Appl. No.: 699,356

[22] Filed: Feb. 7, 1985

[51] Int. Cl.[4] ..... E04G 1/34

[52] U.S. Cl. ..... 182/152; 182/118; 182/179

[58] Field of Search ..... 182/152, 118, 119, 178, 182/179, 153; 135/67, 74; 211/195, 201; 403/116

[56] References Cited

U.S. PATENT DOCUMENTS

| | | | |
|---|---|---|---|
| 139,862 | 9/1903 | Harrod | 182/152 |
| 2,852,145 | 9/1958 | Scholz | 211/204 |
| 2,900,158 | 8/1959 | Ditter | 182/153 |
| 2,925,921 | 2/1960 | De Pew | 211/189 |
| 3,011,586 | 12/1961 | Harvey | 182/152 |
| 3,493,208 | 2/1970 | Sato | 248/235 |
| 3,516,425 | 6/1970 | Rigal | 135/67 |
| 3,616,469 | 11/1971 | Injeski | 403/116 |
| 3,858,683 | 1/1975 | Rachocki | 182/206 |
| 4,439,052 | 3/1984 | Wallther | 182/179 |
| 4,534,447 | 8/1985 | Champigny | 182/222 |

FOREIGN PATENT DOCUMENTS

| | | | |
|---|---|---|---|
| 1135256 | 12/1956 | France | 182/152 |

OTHER PUBLICATIONS

Genie Industries, printed 6/84.

*Primary Examiner*—Reinaldo P. Machado
*Attorney, Agent, or Firm*—Woodward, Weikart, Emhardt & Naughton

[57] ABSTRACT

A collapsible scaffold. A pair of spaced apart vertical ladder configured frames include horizontally extending members upon which may rest a board or other supporting surface. A pair of cross members are pivotally mounted to the upstanding posts of the frames and have their outer distal ends positioned and hingedly secured together. A sleeve rigidly attached to one distal end of the cross member extends around the adjacent distal end of the second cross member. A window in the sleeve forms a stop surface through which a projection on the other distal end extends limiting the amount of relative motion between the cross frames.

2 Claims, 5 Drawing Figures

COLLAPSIBLE SCAFFOLD

BACKGROUND OF THE INVENTION

This invention is in the field of scaffolds including scaffold hinges to facilitate the collapsing of the scaffold. It is desirable to store scaffolds when moving from working site to working site. Further, the scaffold must be collapsible to facilitate the move and in case the scaffold is to be stored in a relatively small storage space. Thus, many of the scaffolds may be taken apart requiring the disassembly of many fasteners and subassemblies. The scaffold must be reassembled when needed requiring not only time and effort but also providing a nuisance to the user. Further, the scaffold may be used in a cold environment adding to the dificulty of reassembling the fasteners and subassemblies. It is therefore desirable to provide a scaffold which will collapse without the necessity of disassembly. Collapsible scaffolds have been previously utilized; however, such collapsible scaffolds typically provide unstable platforms as compared to the non-collapsible scaffolds. It is therefore further desirable to provide a scaffold which when erected will provide a stable platform while at the same time allowing for quick and easy collapsing for storage purposes. A number of U.S. Patents have been granted on scaffolds and assorted frames such as shown in U.S. Pat. Nos. 2,852,145, issued to Scholz; 2,925,921, issued to De Pew et al.; 3,493,208, issued to Sato; and 4,439,052, issued to Wallther.

SUMMARY OF THE INVENTION

One embodiment of the present invention is a scaffold comprising a first vertical frame, a second vertical frame spaced apart from but connected to the first vertical frame, a first cross frame hving a proximal end pivotally mounted to the first vertical frame and further having a outer distal end with a sleeve fixedly secured thereto, and a second cross frame having a proximal end pivotally mounted to the second vertical frame and further having an outer distal end extending through and pivotal within the sleeve connecting the first cross frame and the second cross frame together and allowing the first cross frame and the second cross frame to pivot adjacent respectively the first vertical frame and the second vertical frame when the scaffold is collapsed and to pivot outwardly positioning the first vertical frame and the second vertical frame apart when erected.

A further embodiment of the present invention is an assembly to support a person comprising a first ladder including a pair of vertical posts and a plurality of horizontal steps interconnecting the vertical posts, a second ladder including a pair of vertical posts and a plurality of horizontal steps interconnecting the posts of the second ladder, a flat board shaped member positionable atop one of the steps of the first ladder and atop one of the steps of the second ladder and providing a supporting surface to support a person thereatop, a first tubular frame including a pair of aligned sleeve shaped proximal ends pivotally mounted to the top and bottom of the first ladder, the tubular frame also including a vertical extending first tubular distal end with the tubular frame converging from the proximal ends to the distal end, a second tubular frame including a second pair of aligned sleeve shaped proximal ends pivotally mounted to the top and bottom of the second ladder, the second tubular frame also including a vertical extending second tubular distal end positioned adjacent the first tubular distal end with the second tubular frame converging from the second pair of proximal ends to the second tubular distal end, and locking means including a projection and associated window with projection engageable stop surface to connect together the distal end of the first tubular frame and the second tubular frame and operable to allow the first tubular frame and the second tubular frame to pivot through a maximum angle of approximately ninety degrees from against respectively the first ladder and the second ladder to an erected position wherein the first tubular frame and the second tubular frame extend outwardly from each ladder and space the first ladder apart from the second ladder.

It is an object of the present invention to provide a new and improved scaffold.

A further object of the present invention is to provide a collapsible scaffold which provides a stable platform when erected.

In addition, it is an object of the present invention to provide a scaffold which is collapsible for storage purposes without necessitating disassembly.

Related objects and advantages of the present invention will be apparent from the following description.

DESCRIPTION OF THE PREFERRED EMBODIMENT

Figure 1:
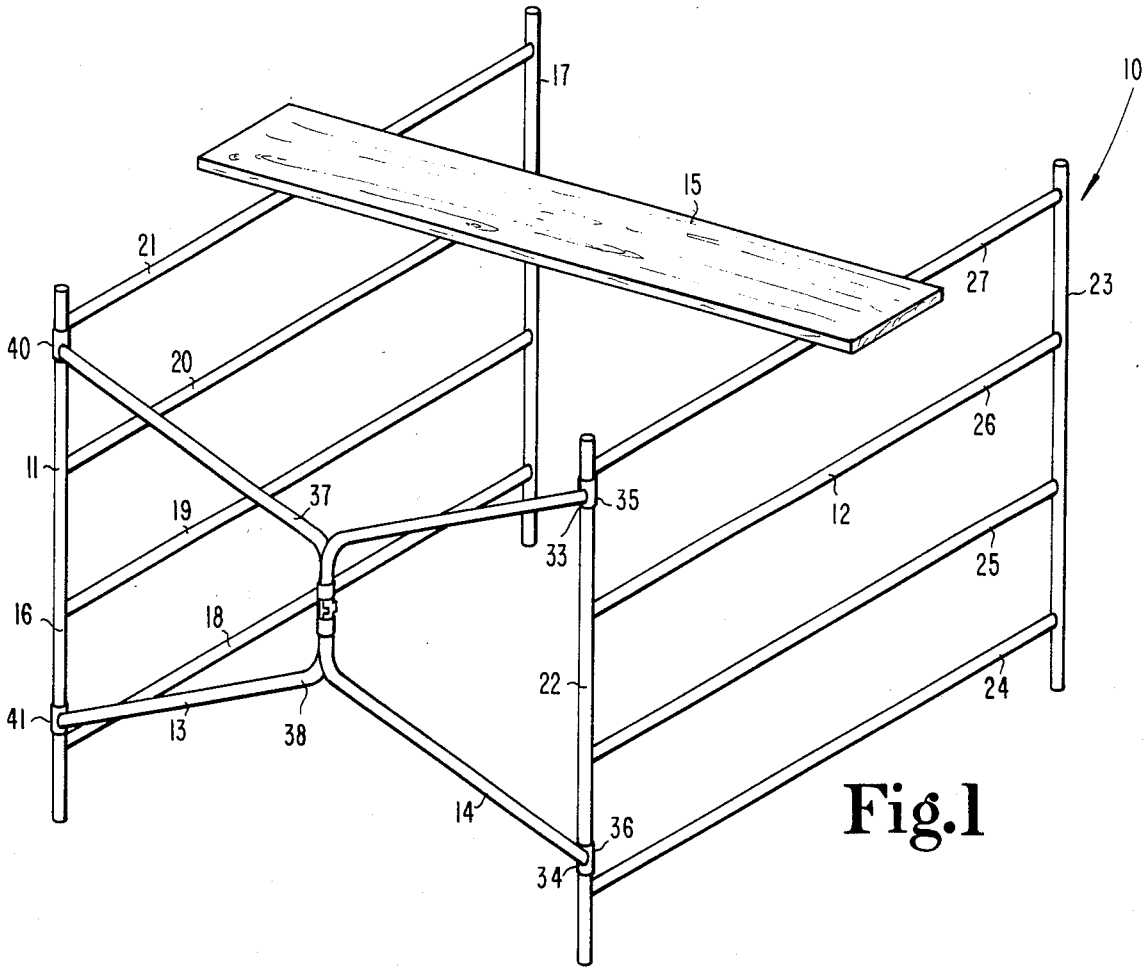
FIG. 1 is a perspective view of the collapsible scaffold incorporating the present invention.
Figure 2:
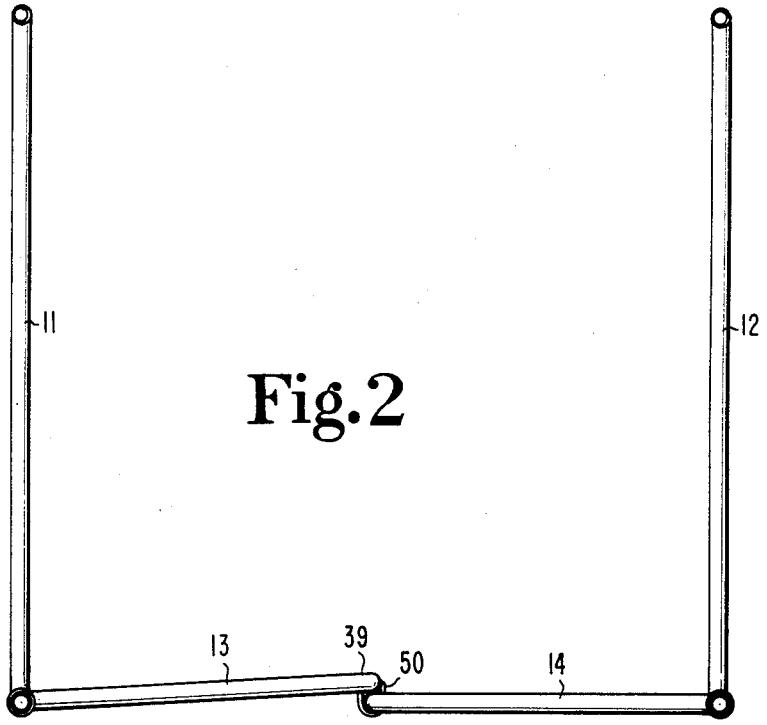
FIG. 2 is a top view of the scaffold of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a collapsible scaffold 10 which is the preferred embodiment of the present invention. Scaffold 10 includes a first ladder configured frame 11 and a second ladder configured frame 12 both extending vertically and interconnected together by a first cross frame 13 and second cross frame 14. Cross frames 13 and 14 are pivotally joined at the center of the scaffold and have their outer ends pivotally mounted to the upstanding posts of vertical frames 11 and 12. A board 15 is positioned atop any two of the aligned horizontal steps or rods of each frame 11 and 12 providing a platform upon which a person may stand.

Frame 11 has a pair of upstanding tubular members 16 and 17 secured by welding or other suitable means to four horizontally extending tubular members 18–21. The upstanding posts are rigidly attached to the horizontal members providing for a rigid frame. Similarly, frame 12 has a pair of upstanding posts 22 and 23 rigidly attached to four horizontal tubular members 24–27. The horizontal tubular members 24–27 being rigidly attached to the upstanding posts provide a rigid vertical frame. The horizontal members 18–21 and 24–27 form board support surfaces upon which a board may be positioned which extends across from the first vertical frame to the second vertical frame. For example, the top surface of members 21 and 27 provide a horizontal support surface to support board 15. In addition, the horizontal members may be used as steps to enable a person to climb atop board 15.

Figure 3:
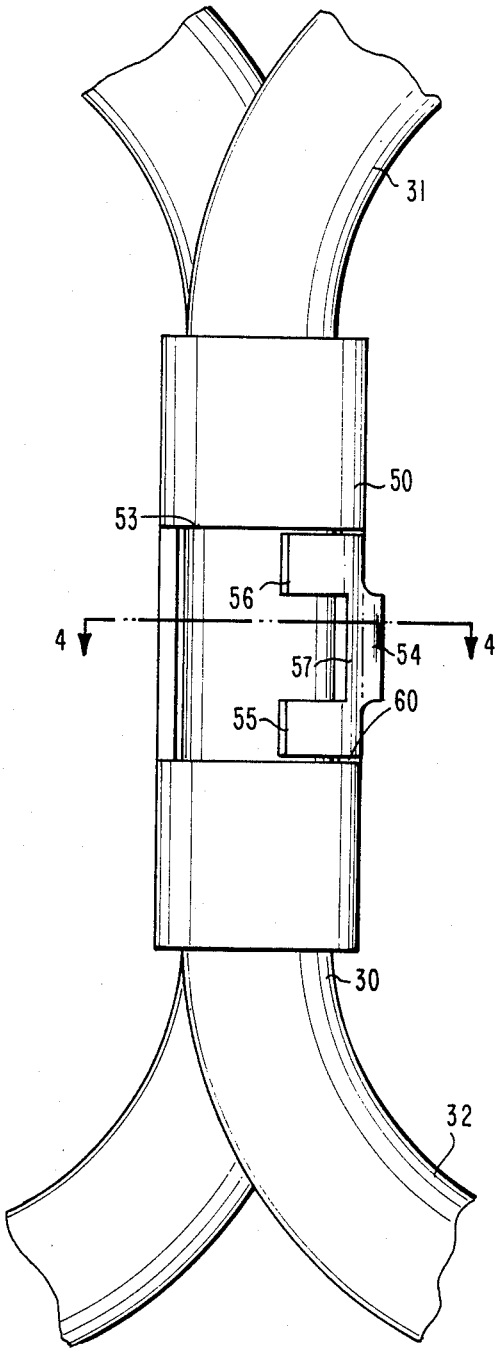
FIG. 3 is a fragmentary enlarged view of the center hinge of the scaffold of FIG. 1.
Figure 4:
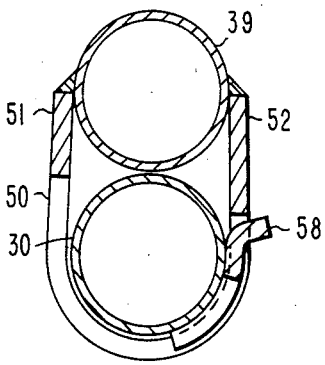
FIG. 4 is a cross-sectional view along the line 4—4 of FIG. 3 and viewed in the direction of the arrows.

Cross frame 14 has a tubular vertically extending distal end 30 (FIG. 3) integrally connected to a top tubular portion 31 and bottom tubular portion 32 which in turn extend outwardly to their respective proximal ends 33 and 34 (FIG. 1). A pair of aligned sleeve shaped mounting elements 35 and 36 are respectively attached to ends 33 and 34 with the sleeve shaped elements extending freely around upstanding post 22. The top tubular element 31 and bottom tubular element 32 converge from proximal ends 33 and 34 to distal end 30 allowing each to extend generally in a diagonal direction from frame 12 towards frame 11. Likewise, cross frame 13 has a top and bottom tubular member 37 and 38 which are integrally attached to a vertically extending tubular distal end 39 at one end and attached at their opposite proximal ends to a pair of algined sleeve shaped mounting elements 40 and 41. Elements 40 and 41 are mounted to upstanding post 16 and are freely pivotable thereon as are elements 35 and 36 relative to upstanding post 22. The top and bottom tubular portions 37 and 38 extend convergingly from their proximal ends to the vertical distal end 39 which is positioned immediately adjacent the tubular vertically extending distal end 30 of the other cross member as shown in FIG. 4.

Figure 5:
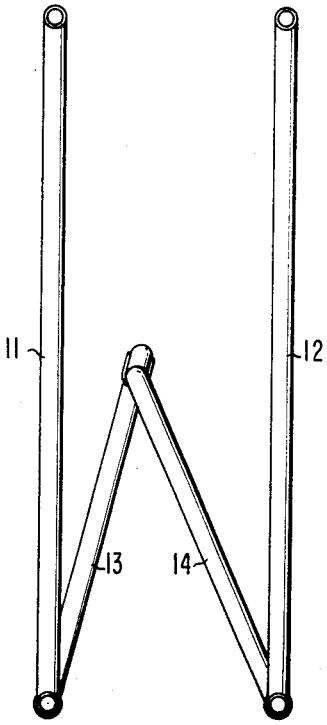
FIG. 5 is a reduced top view of the scaffold shown in the collapsed condition.

A locking means is provided on the adjacent distal ends 30 and 39 (FIG. 4) to hingedly connect the cross frames together while limiting the amount of pivotable motion therebetween. A U-shaped sleeve 50 has its proximal ends 51 and 52 fastened to distal end 39 with the sleeve then extending away from distal end 39 and around distal end 30. A window 53 is formed in sleeve 50 and receives a locking projection 54 mounted by welding or other suitable means to distal end 30. Locking projection 54 has a main body with a pair of spaced apart legs 55 and 56 extending at least partially around distal end 30 and fixedly attached thereto. A cross member 57 joins legs 55 and 56 integrally together with the cross member including a stop portion 58 extending radially from distal end 30. Projection 54 is positioned within window 53 with portion 58 located to contact edge 60 of window 53 which forms a stop surface limiting pivotal motion between the two distal ends. For example, when the scaffold is in the collapsed condition (FIG. 5), cross members 13 and 14 are positioned adjacent and between vertical frames 11 and 12. As cross frames 13 and 14 are pivoted to the erect position shown in FIG. 1, portion 58 of projection 54 will eventually contact stop surface 60 thereby stabilizing the cross frames. The window and projection therefore provide a locking means which limit the pivotal motion of each cross frame relative to its attached vretical frame to an angle of approximately 90°.

The stability of the assembly is increased by locating the sleeve shaped mounting elements 40 and 35 immediately beneath and adjacent the horizontally extending members 21 and 27. Likewise, the bottom two sleeve shaped mounting elements 41 and 36 are located immediately atop and against horizontal members 18 and 24 preventing the cross frames from moving in a vertical direction while the window and projection limit the amount of horizontal pivoting motion of the cross frames. These stop surfaces significantly increase the overall stability of the scaffold.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An assembly to support a person comprising:

a first ladder including a pair of vertical posts and a plurality of horizontal steps interconnecting said vertical posts;

a second ladder including a pair of vertical posts and a plurality of horizontal steps interconnecting said posts of said second ladder;

a flat board shaped member positionable atop one of said steps of said first ladder and atop one of said steps of said second ladder and providing a supporting surface to support a person thereatop;

a first tubular frame including a pair of aligned sleeve shaped proximal ends pivotally mounted to the top and bottom of said first ladder, said tubular frame also including a vertical extending first tubular distal end with said tubular frame converging from said proximal ends to said distal end;

a second tubular frame including a second pair of aligned sleeve shaped proximal ends pivotally mounted to the top and bottom of said second ladder, said second tubular frame also including a vertical extending second tubular distal end positioned adjacent said first tubular distal end with said second tubular frame converging from said second pair of proximal ends to said second tubular distal end;

locking means including a projection and associated window with projection engageable stop surface to connect together said distal end of said first tubular frame and said second tubular frame and operable to allow said first tubular frame and said second tubular frame to pivot through a maximum angle of approximately ninety degrees from against respectively said first ladder and said second ladder to an erected position wherein said first tubular frame and said second tubular frame extend outwardly from each ladder and space said first ladder apart from said second ladder; and wherein, said locking means includes a sleeve mounted to but adjacent said second tubular distal end with said first tubular distal end extending through said sleeve and being pivotal therein, said sleeve includes a window formed thereon opening outwardly defining a stop surface, said first tubular distal end includes a projection fixedly mounted thereon positioned within said window and contacting said stop surface when said first tubular frame and said second tubular frame pivot ninety degrees away from said first ladder and said second ladder; and wherein:

said projection includes a main body with a pair of spaced apart legs extending at least partially around said first distal end and being fixedly attached thereto, said main body further includes a cross member joining said legs integrally together with said cross member including a radially extending portion positioned in said window and limiting relative motion between said first distal end and and said second distal end.

2. The assembly of claim 1 wherein:

said first tubular frame and said second tubular frame when pivoted against said first ladder and said second ladder are positioned between said first ladder and said second ladder.

* * * * *